US011680766B2

(12) United States Patent
Nedev

(10) Patent No.: US 11,680,766 B2
(45) Date of Patent: Jun. 20, 2023

(54) FIREARM WITH CHARGING HANDLE SLOT COVER

(71) Applicant: Caracal International, LLC, Abu Dhabi (AE)

(72) Inventor: Konstantin Nedev, Abu Dhabi (AE)

(73) Assignee: CARACAL INTERNATIONAL, LLC, Abu Dhabi (AE)

( * ) Notice: Subject to any disclaimer, the term of this patent is extended or adjusted under 35 U.S.C. 154(b) by 0 days.

(21) Appl. No.: 17/551,334

(22) Filed: Dec. 15, 2021

(65) Prior Publication Data

US 2022/0196360 A1 Jun. 23, 2022

Related U.S. Application Data

(60) Provisional application No. 63/128,268, filed on Dec. 21, 2020.

(51) Int. Cl.

| | |
|---|---|
| ***F41A 35/02*** | (2006.01) |
| ***F41A 3/66*** | (2006.01) |
| ***F41A 3/72*** | (2006.01) |

(52) U.S. Cl.

CPC ..... *F41A 35/02* (2013.01); *F41A 3/66* (2013.01); *F41A 3/72* (2013.01)

(58) Field of Classification Search

CPC ..... F41A 35/02
USPC ..... 89/1.4
See application file for complete search history.

(56) References Cited

U.S. PATENT DOCUMENTS

| | | | | |
|---|---|---|---|---|
| 1,365,592 A * | 1/1921 | Johnston | F41A 35/02 | 89/1.4 |
| 1,523,067 A | 1/1925 | Hazleton | | |
| 1,533,967 A * | 4/1925 | Browning | F41A 35/02 | 42/25 |
| 4,145,831 A * | 3/1979 | Bourlet | F41A 35/02 | 42/16 |
| 4,443,962 A * | 4/1984 | Bernet | F16J 15/16 | 42/70.11 |
| 9,958,229 B1 * | 5/2018 | Meier | F41A 35/02 | |

OTHER PUBLICATIONS

IWI US, "Galil ACE GEN II Rifle—7.62x39mm with Side Folding Adjustable Buttstock," https://iwi.us/product/galil-ace-gen-ii-rifle-7-62x39mm-gar37/, (c) 2021, Accessed Nov. 2, 2021.

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

Firearms with charging handle slot covers have a receiver defining a passage receiving a reciprocating bolt assembly, the receiver having a wall defining an elongated slot, a handle external to the receiver and having a shank portion extending through the slot and an inner portion connected to the bolt assembly, a slot cover plate connected to the receiver and movable between a closed position at least partly covering the elongated slot and an open position at least partly exposing the elongated slot, and a cover element overlaying at least a portion of the slot cover plate. The slot cover plate may be spring biased to the closed position. The slot cover plate may be an elongated body with opposed ends independently movable with respect to each other. The slot cover plate may be configured to shift to cover the elongated slot away from the shank.

21 Claims, 6 Drawing Sheets

FIREARM WITH CHARGING HANDLE SLOT COVER

CROSS-REFERENCE TO RELATED APPLICATION

This application claims the benefit of U.S. Provisional Patent Application No. 63/128,268 filed on Dec. 21, 2020, entitled "Charging Handle Slot Cover," which is hereby incorporated by reference in its entirety for all that is taught and disclosed therein.

FIELD OF THE INVENTION

The present invention relates to firearms, and more particularly to a firearm that has a dust cover to prevent contamination from entering the firearm through the side charging handle slot.

BACKGROUND AND SUMMARY OF THE INVENTION

Although semi-automatic firearms automatically cycle their bolts during normal operation, there are occasions where the bolt needs to be cycled manually, such as when loading the first round from a fresh magazine. To enable manual cycling, the firearm is equipped with a charging handle. In the case of a side charging handle, the receiver has a long open slot on one side that receives the shank of the side charging handle so the side charging handle can contact the bolt carrier. If the slot is left uncovered, contamination could enter the firearm and interfere with normal firearm operation. It should be appreciated that the side charging handle is non-reciprocating, meaning the side charging handle is not moved by the bolt during normal firearm operation.

Therefore, a need exists for a new and improved firearm with charging handle slot cover that has a dust cover to prevent contamination from entering the firearm through the side charging handle slot. Further, it is desirable that the mechanism be compact and not add to the size of the rifle, and that the slot be as protected as possible when the bolt is closed in battery, but also that there be some protection in other conditions. In this regard, the various embodiments of the present invention substantially fulfill at least some of these needs. In this respect, the firearm with charging handle slot cover according to the present invention substantially departs from the conventional concepts and designs of the prior art, and in doing so provides an apparatus primarily developed for the purpose of enabling the firearm to have a dust cover to prevent contamination from entering the firearm through the side charging handle slot.

The present invention provides an improved firearm with charging handle slot cover, and overcomes the above-mentioned disadvantages and drawbacks of the prior art. As such, the general purpose of the present invention, which will be described subsequently in greater detail, is to provide an improved firearm that has all the advantages of the prior art mentioned above.

To attain this, the preferred embodiment of the present invention essentially comprises a receiver defining a passage receiving a reciprocating bolt assembly, the receiver having a wall defining an elongated slot, a handle external to the receiver and having a shank portion extending through the slot and an inner portion connected to the bolt assembly, a slot cover plate connected to the receiver and movable between a closed position at least partly covering the elongated slot and an open position at least partly exposing the elongated slot, and a cover element overlaying at least a portion of the slot cover plate. The slot cover plate may be spring biased to the closed position. The slot cover plate may be an elongated body with opposed ends independently movable with respect to each other. The slot cover plate may be configured to shift to cover the elongated slot in a first area away from the shank, and to shift to reveal the elongated slot proximate to the shank. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
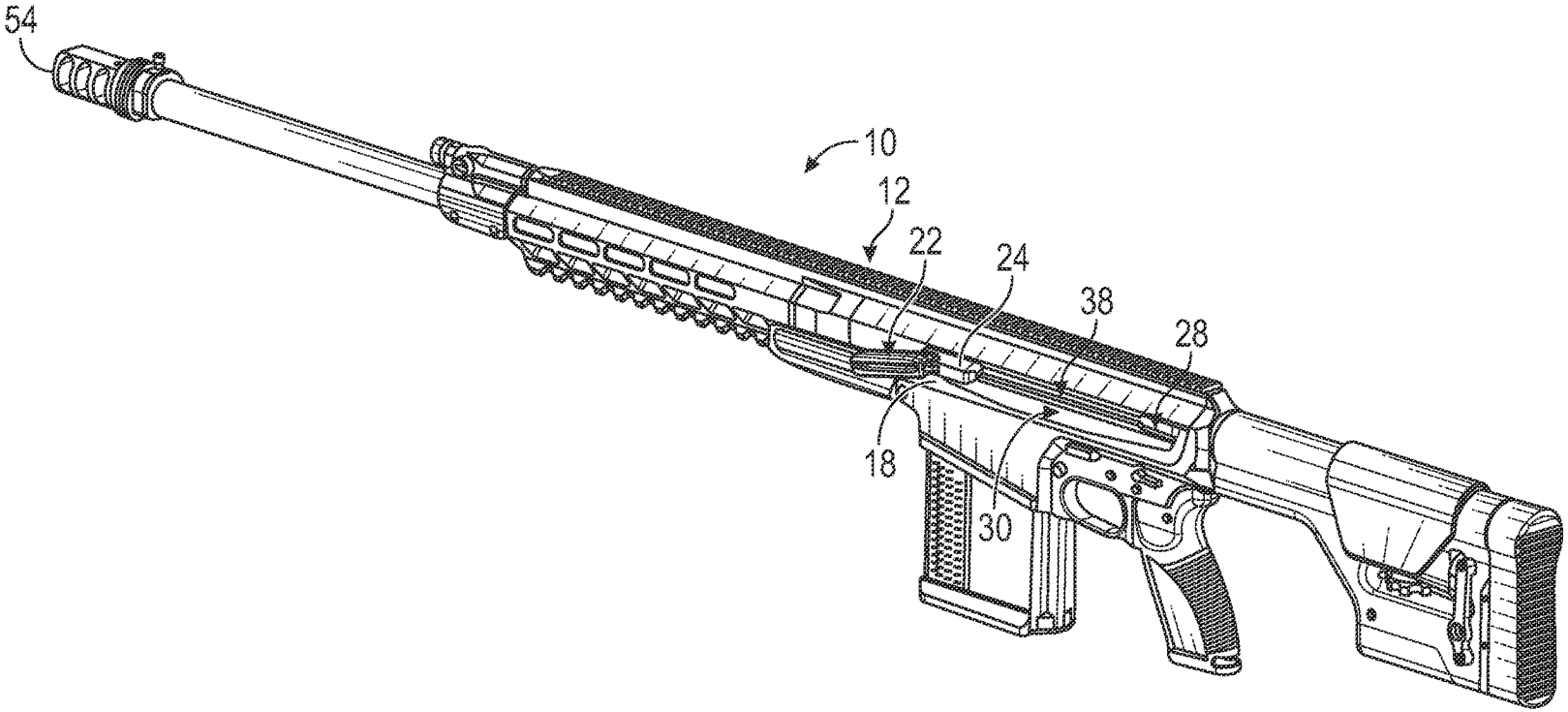
FIG. 1 is a top isometric view of the current embodiment of a firearm with charging handle slot cover constructed in accordance with the principles of the present invention.

An embodiment of the firearm with charging handle slot cover of the present invention is shown and generally designated by the reference numeral 10.

Figure 2:
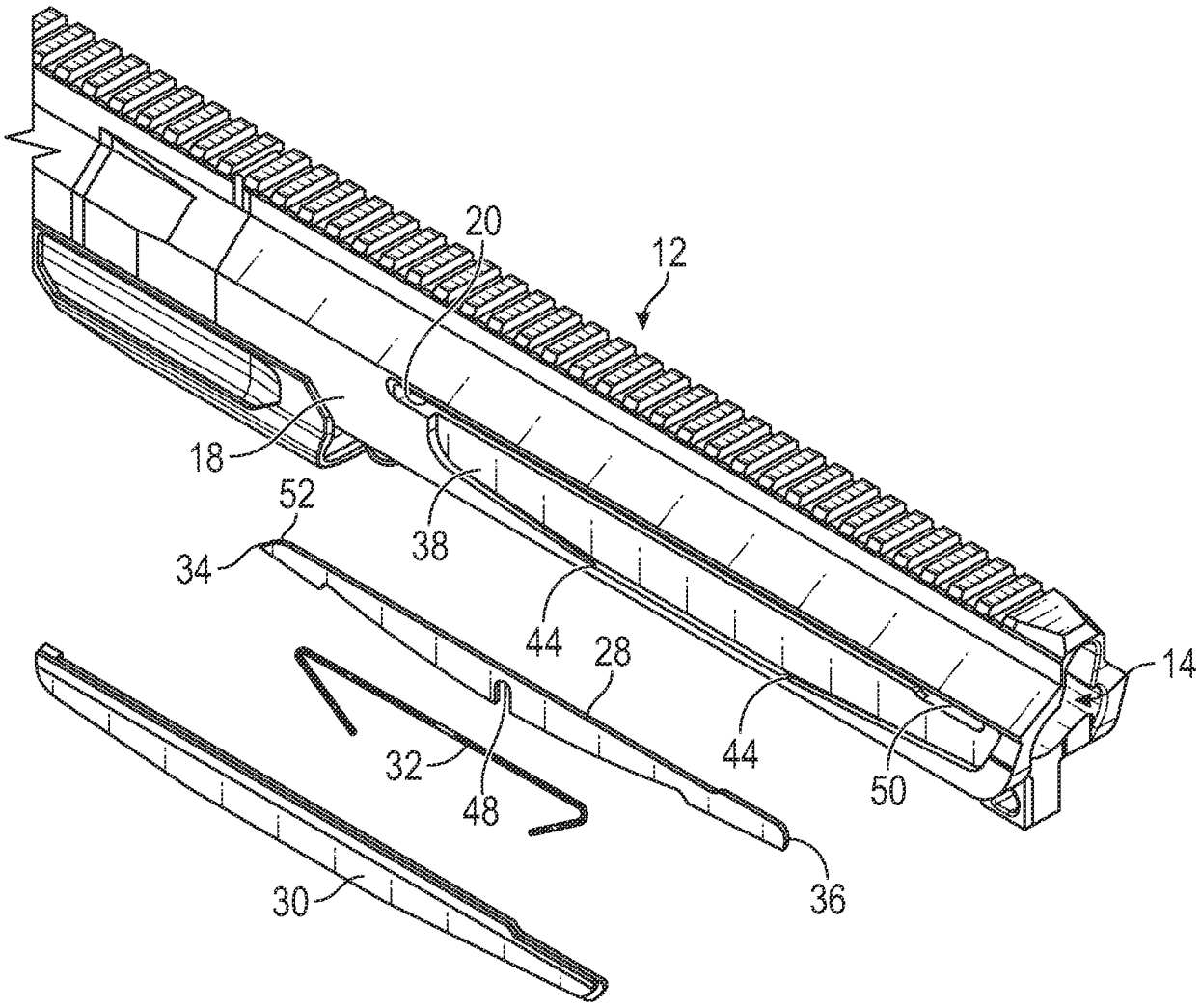
FIG. 2 is an exploded partial view of the receiver of FIG. 1.
Figure 3:
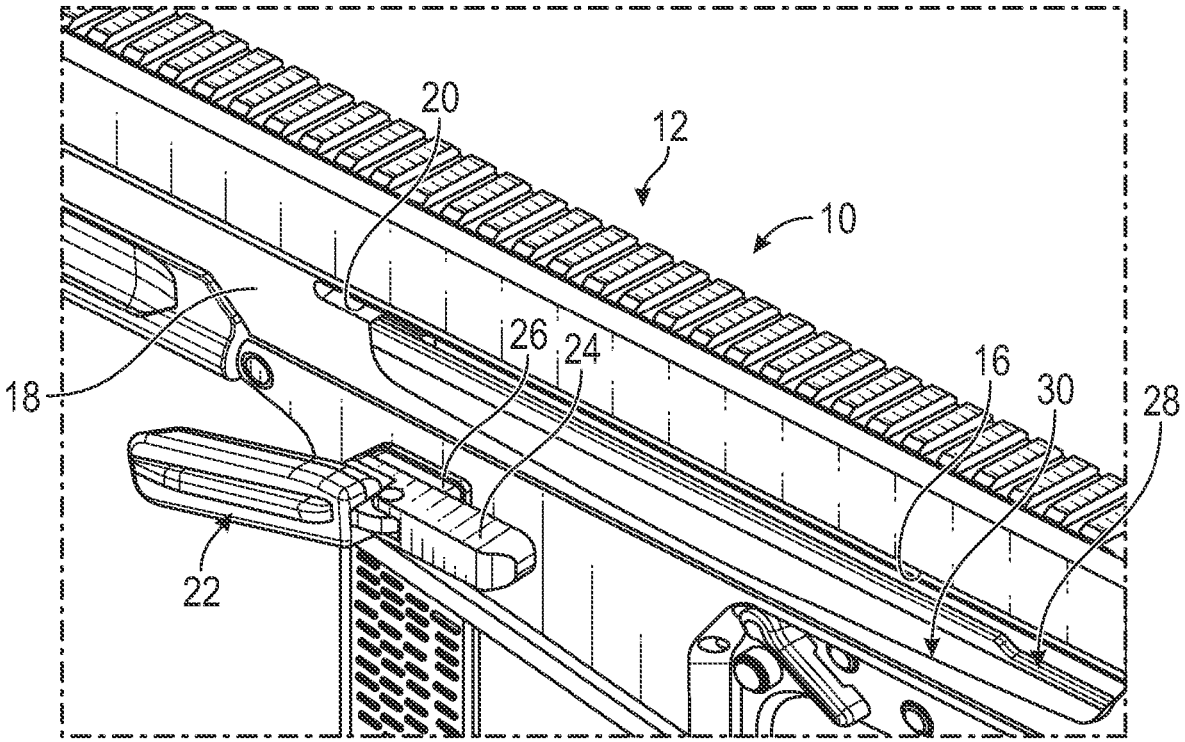
FIG. 3 is a top isometric view of the receiver of FIG. 1 with the handle disassembled.
Figure 4A:
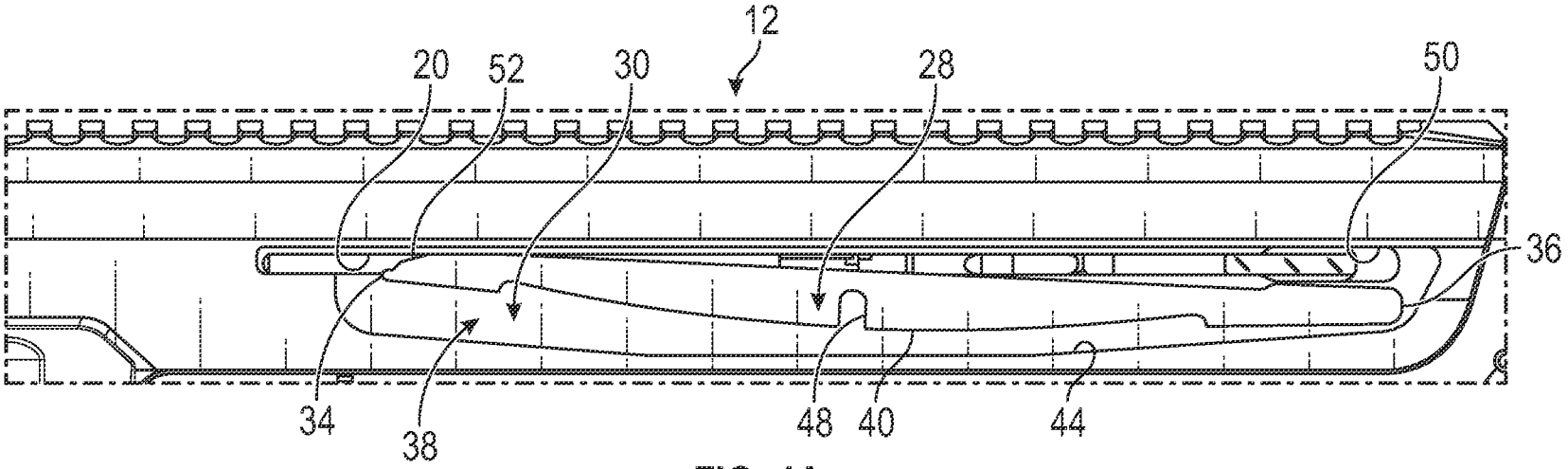
FIG. 4A is side partial view of the receiver of FIG. 1 showing the position of the slot cover plate with the handle, cover element, and spring removed for disassembly.
Figure 4B:
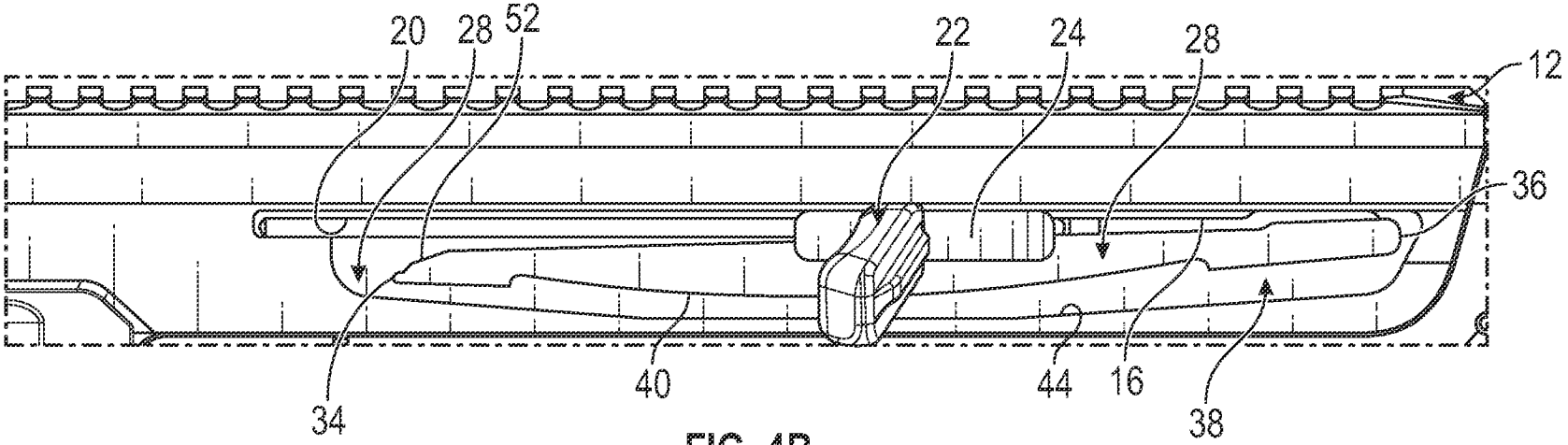
FIG. 4B is a side partial view of the receiver of FIG. 1 with the handle in the process of moving towards the forward position. The spring and cover element are omitted for clarity.
Figure 4C:
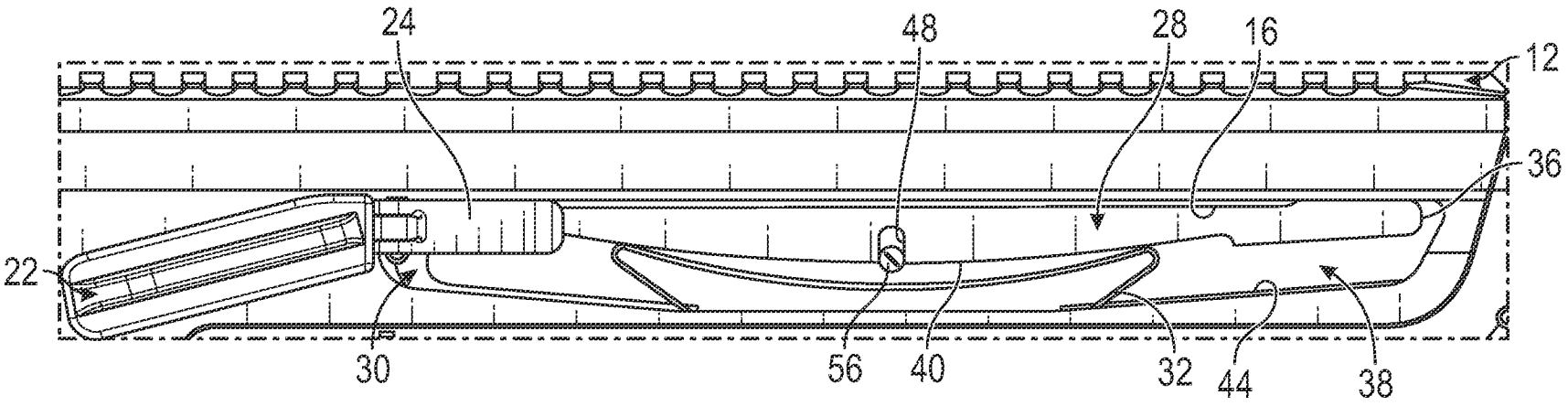
FIG. 4C is a side partial view of the receiver of FIG. 1 with the handle in a forward position. The spring and boss on the inner side of the cover element are also shown.

FIG. 1 illustrates the improved firearm with charging handle slot cover 10 of the present invention, and FIGS. 2 & 3 are exploded views of portions of the firearm. FIGS. 4A-C show various positions of the slot cover plate 28. More particularly, the firearm has a receiver 12 defining a passage 14 receiving a reciprocating bolt assembly (not shown). The receiver also has a wall 18 defining an elongated slot 20. A handle 22 external to the receiver has a shank portion 24 extending through the elongated slot and an inner portion 26 connected to the reciprocating bolt assembly. A slot cover plate 28 is connected to the receiver and is movable between a closed position at least partly covering the elongated slot and an open position at least partly exposing the elongated slot. A cover element 30 is closely fit to the exterior of the receiver and includes a boss 56 (shown in FIG. 4C) on an interior surface. The cover element overlays at least a portion of the slot cover plate.

Figure 5:
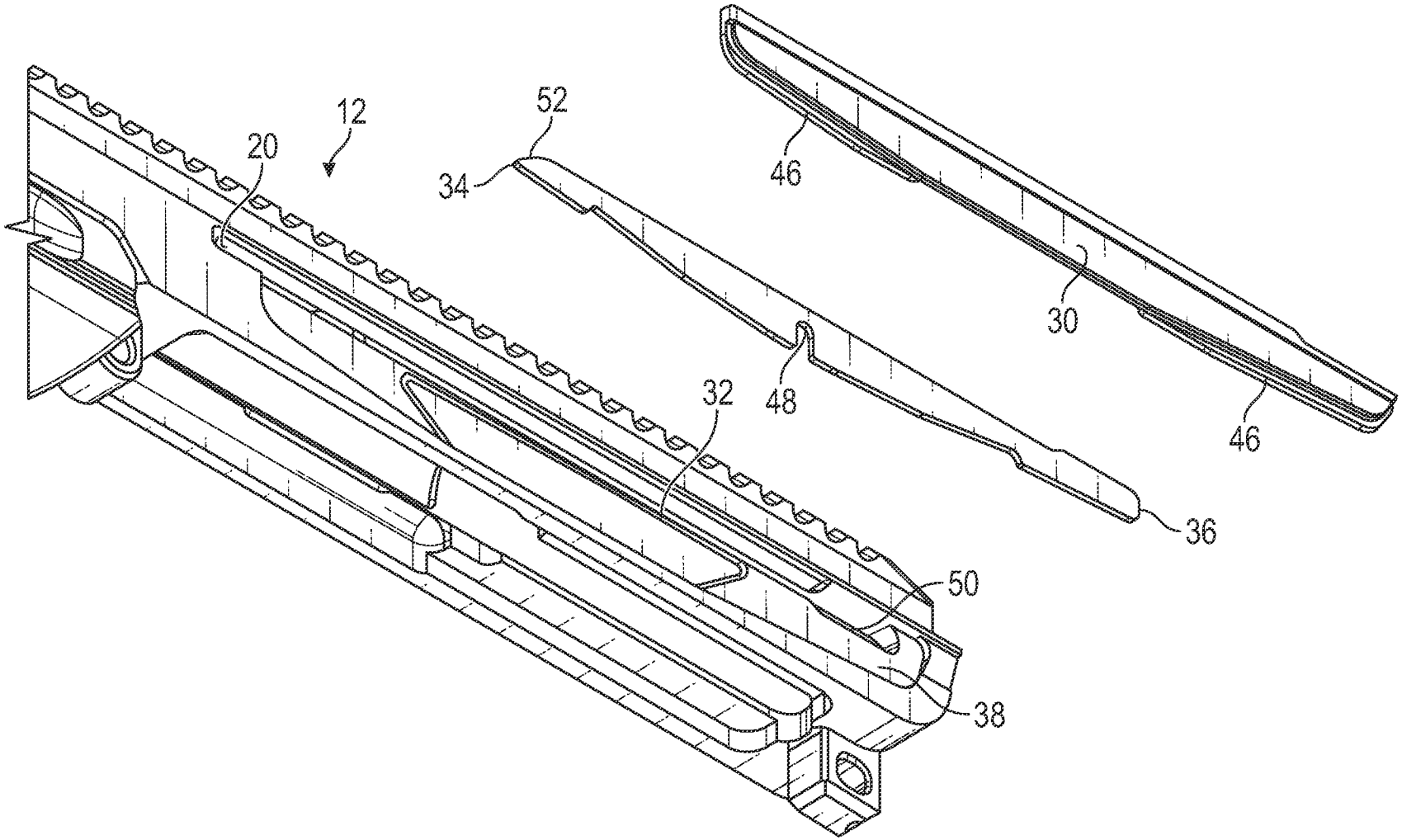
FIG. 5 is an exploded partial view of the receiver of FIG. 1.

The slot cover plate 28 is spring biased by a spring 32 operably engaged between the slot cover plate and the cover element 30 to the closed position in the current embodiment. The slot cover plate is biased toward the elongated slot 20. The slot cover plate is an elongated body with opposed front and rear ends 34, 36 independently movable with respect to each other so that the cover has a vertical range of motion at each end, moving independently of the other, and thus the cover has an angular range of motion to pitch up or down. Movement of the slot cover plate is constrained by the cover element and the receiver 12. The slot cover plate is configured to shift to cover the elongated slot 20 in a first area 16 away from the shank portion 24, and to shift to reveal the elongated slot proximate to the shank. This is accomplished by the slot cover plate pivoting about the boss 56 on an interior surface of the cover element, which is received in a downward opening slot 48 defined by an elongated edge portion 40 of the cover element. When the reciprocating bolt assembly is in a forward position, the slot cover plate entirely covers the slot, which is shown in FIG. 4C. The cover element covers a major portion of the slot cover plate. The cover element and the receiver 12 define a cover plate receptacle 38 that is a thin pocket receiving the elongated edge portion 40 of the slot cover plate away from the elongated slot. The slot cover plate defines a slot cover plate plane. The slot cover plate is constrained to shift only within the slot cover plate plane. The cover element is constrained at at least one end against elevation, by way of peripheral flanges 46 shown at the bottom front and rear of the slot cover plate in FIG. 5 and which engage grooves 44 defined by the receiver adjacent to the elongated slot. The cover element is constrained against movement out of its own plane by the peripheral flanges of the cover element being received in the grooves. Disassembly requires the forward end of the slot cover plate to be elevated against the pressure of spring 32, whose lower leg ends bear against an internal step on the slot cover plate.

The slot cover plate 28, cover element 30, and spring 32 can be disassembled for field maintenance without tools by first removing the reciprocating bolt assembly from the passage 14. This allows the handle 22 to be pulled further rearward than is the case during normal operation to align the inner portion 26 of the handle with an enlarged portion 50 of the elongated slot 20. Once aligned, the handle can be withdrawn from the slot, which in turn enables the cover element, spring, and slot cover plate to be detached from the receiver 12. FIG. 4A shows the receiver with the handle, cover element, and spring already removed.

FIG. 4B shows the handle 22 in the process of returning to the forward position after maintenance or after having released a retracted charging handle to charge the firearm 10. Once the handle reaches the forward position shown in FIG. 4C, a cutout 52 on the front end 34 of the cover element 30 enables the cover to fully close to cover the entire slot. This provides maximum protection for the condition when the rifle is stored, or armed and ready for operation. This also enables the handle to be moved rearwardly without appreciable resistance to charge the firearm 10. The handle is non-reciprocating, meaning the handle is not moved from the forward position by the reciprocating bolt assembly during normal firearm operation.

In the context of the specification, the terms "rear" and "rearward," and "front" and "forward" have the following definitions: "rear" or "rearward" means in the direction away from the muzzle 54 of the firearm while "front" or "forward" means it is in the direction towards the muzzle of the firearm.

While a current embodiment of a firearm with charging handle slot cover has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a receiver defining a passage receiving a reciprocating bolt assembly;

the receiver having a wall defining an elongated slot;

a handle external to the receiver and having a shank portion extending through the elongated slot and an inner portion connected to the reciprocating bolt assembly;

a slot cover plate connected to the receiver and movable between a closed position at least partly covering the elongated slot and an open position at least partly exposing the elongated slot;

a cover element overlaying at least a portion of the slot cover plate; and a spring operably biasing between the cover plate and the cover element without biasing against the receiver.

2. The firearm of claim 1 wherein the slot cover plate is spring biased to the closed position.

3. The firearm of claim 1 wherein the slot cover plate is an elongated body with opposed ends independently movable with respect to each other.

4. The firearm of claim 1 wherein the slot cover plate is configured to shift to cover the elongated slot in a first area away from the shank portion, and to shift to reveal the elongated slot proximate to the shank portion.

5. The firearm of claim 1 wherein when the reciprocating bolt assembly is in a forward position, the slot cover plate entirely covers the elongated slot.

6. The firearm of claim 1 wherein when the reciprocating bolt assembly is in a forward position, the slot cover plate is in a maximum coverage position.

7. The firearm of claim 1 wherein the cover element covers at least a portion of the slot cover plate.

8. The firearm of claim 1 wherein the cover element and the receiver define a cover plate receptacle receiving an elongated edge portion of the slot cover plate away from the elongated slot.

9. The firearm of claim 1 wherein the slot cover plate is biased toward the elongated slot.

10. The firearm of claim 1 wherein the slot cover plate defines a slot cover plate plane, and wherein the slot cover plate is constrained to shift only within the slot cover plate plane.

11. The firearm of claim 1 wherein the cover element is constrained at at least one end against movement toward the elongated slot.

12. The firearm of claim 1 wherein the receiver defines a groove adjacent to the elongated slot, and wherein the cover element has a peripheral flange received in the groove.

13. A firearm comprising:

a receiver defining a passage receiving a reciprocating bolt assembly;

the receiver having a wall defining an elongated slot;

a handle external to the receiver and having a shank portion extending through the elongated slot and an inner portion connected to the reciprocating bolt assembly;

a slot cover plate connected to the receiver and movable between a closed position at least partly covering the elongated slot and an open position at least partly exposing the elongated slot;

a cover element overlaying at least a portion of the slot cover plate; and the cover plate defining a slot configured to engage a boss to limit axial movement of the cover plate.

14. The firearm of claim 13 wherein the slot cover plate is spring biased to the closed position.

15. The firearm of claim 13 wherein the slot cover plate is an elongated body with opposed ends independently movable with respect to each other.

16. The firearm of claim 13 wherein the slot cover plate is configured to shift to cover the elongated slot in a first area away from the shank portion, and to shift to reveal the elongated slot proximate to the shank portion.

17. The firearm of claim 13 wherein when the reciprocating bolt assembly is in a forward position, the slot cover plate entirely covers the elongated slot.

18. The firearm of claim 13 wherein when the reciprocating bolt assembly is in a forward position, the slot cover plate is in a maximum coverage position.

19. The firearm of claim 13 wherein the cover element and the receiver define a cover plate receptacle receiving an elongated edge portion of the slot cover plate away from the elongated slot.

20. The firearm of claim 13 wherein the slot cover plate is biased toward the elongated slot.

21. The firearm of claim 13 including a spring operably engaged between the slot cover plate and the cover element.

* * * * *